US010221373B2

(12) United States Patent
Mitrovich et al.

(10) Patent No.: US 10,221,373 B2
(45) Date of Patent: Mar. 5, 2019

(54) LUBRICANT COMPOSITIONS

(71) Applicant: MPL Innovations, Inc., Seattle, WA (US)

(72) Inventors: Michael J. Mitrovich, Seattle, WA (US); Bret Lanz, Manhattan, KS (US); Matt Molz, Wamego, KS (US)

(73) Assignee: MPL INNOVATIONS, INC., Seattle, WA (US)

( * ) Notice: Subject to any disclaimer, the term of this patent is extended or adjusted under 35 U.S.C. 154(b) by 188 days.

(21) Appl. No.: 15/462,151

(22) Filed: Mar. 17, 2017

(65) Prior Publication Data

US 2017/0190997 A1 Jul. 6, 2017

Related U.S. Application Data

(63) Continuation of application No. 14/033,159, filed on Sep. 20, 2013, now abandoned.

(60) Provisional application No. 61/704,097, filed on Sep. 21, 2012.

(51) Int. Cl.

| | |
|---|---|
| ***C10M 169/04*** | (2006.01) |
| ***C10M 145/22*** | (2006.01) |
| ***C10M 125/02*** | (2006.01) |
| ***C10M 125/22*** | (2006.01) |
| ***B61K 3/02*** | (2006.01) |
| ***C10M 129/02*** | (2006.01) |

(52) U.S. Cl.

CPC ..... *C10M 145/22* (2013.01); *B61K 3/02* (2013.01); *C10M 125/02* (2013.01); *C10M 125/22* (2013.01); *C10M 129/02* (2013.01); *C10M 169/04* (2013.01); *C10M 2201/041* (2013.01); *C10M 2201/062* (2013.01); *C10M 2201/066* (2013.01); *C10M 2201/102* (2013.01); *C10M 2201/103* (2013.01); *C10M 2205/0225* (2013.01); *C10M 2207/2835* (2013.01); *C10M 2207/34* (2013.01); *C10M 2207/345* (2013.01); *C10M 2207/40* (2013.01); *C10M 2207/401* (2013.01); *C10M 2207/402* (2013.01); *C10M 2209/102* (2013.01); *C10M 2209/1023* (2013.01); *C10N 2230/06* (2013.01); *C10N 2230/64* (2013.01); *C10N 2250/08* (2013.01)

(58) Field of Classification Search

CPC ..... C10M 145/22; C10M 129/02; C10M 169/04; C10M 125/22; C10M 125/02; C10M 2209/102; C10M 2207/40; C10M 2207/402; C10M 2201/066; C10M 2207/401; C10M 2209/1023; C10M 2207/2835; C10M 2205/0225; C10M 2201/103; C10M 2201/102; C10M 2207/345; C10M 2201/062; C10M 2201/041; C10M 2207/34; B61K 3/02; C10N 2230/06; C10N 2230/64; C10N 2250/08

See application file for complete search history.

(56) References Cited

U.S. PATENT DOCUMENTS

| | | | |
|---|---|---|---|
| 1,137,023 | A | 4/1915 | Rogers |
| 2,207,146 | A | 7/1940 | Fentress |
| 2,223,504 | A | 12/1940 | Abbott |
| 2,589,582 | A | 3/1952 | Strughold |
| 3,014,865 | A | 12/1961 | Seniff |
| 3,433,742 | A | 3/1969 | Banta |
| 3,537,819 | A | 11/1970 | Wiesboeck |
| 3,541,011 | A | 11/1970 | Davis |
| 3,607,746 | A | 9/1971 | Caruso |
| 3,729,415 | A | 4/1973 | Davis et al. |
| 3,944,025 | A | 3/1976 | Owen |
| 4,052,323 | A | 10/1977 | Feneberger et al. |
| 4,146,487 | A | 3/1979 | Rumierz |
| 4,575,430 | A | 3/1986 | Periard et al. |
| 4,647,386 | A | 3/1987 | Jamison |
| 4,659,762 | A | 4/1987 | Jenkins |
| 4,711,320 | A | 12/1987 | Dombroski et al. |
| 4,715,972 | A | 12/1987 | Pacholke |
| 4,763,759 | A | 8/1988 | Federico |
| 4,811,818 | A | 3/1989 | Jamison |
| 4,828,729 | A | 5/1989 | Centers |
| 4,915,856 | A | 4/1990 | Jamison |
| 5,076,339 | A | 12/1991 | Smith |
| 5,173,204 | A | 12/1992 | Chiddick et al. |
| 5,308,516 | A | 5/1994 | Chiddick |
| 5,337,860 | A | 8/1994 | Burke et al. |
| 5,385,683 | A | 1/1995 | Ransom |
| 5,435,925 | A | 7/1995 | Jamison |
| 5,482,637 | A | 1/1996 | Rao et al. |
| 5,668,091 | A | 9/1997 | Grinham et al. |

(Continued)

FOREIGN PATENT DOCUMENTS

| | | | |
|---|---|---|---|
| CH | 669207 | A5 | 2/1989 |
| DE | 29719861 | U1 | 11/1997 |

(Continued)

OTHER PUBLICATIONS

Database WPI. Section Ch. Week 199527, Derwent Publications Ltd., London, GB; AN 1995-200900, XP002213543 & CN 1085245 A (Zhang N), Apr. 13, 1994 (Apr. 13, 1993)—Abstract.

(Continued)

*Primary Examiner* — Taiwo Oladapo
(74) *Attorney, Agent, or Firm* — Colby Nipper PLLC

(57) ABSTRACT

Lubricant composition formulations comprising at least one biodegradable plastic, such as polyhydroxyalkanoate and/or polybutylene succinate, and at least one lubricant, such as a vegetable oil.

20 Claims, No Drawings

(56) References Cited

U.S. PATENT DOCUMENTS

| | | | | |
|---|---|---|---|---|
| 5,955,402 | A * | 9/1999 | Hirata | C08L 67/02 508/100 |
| 6,142,258 | A | 11/2000 | Chepovetsky et al. | |
| 6,182,793 | B1 | 2/2001 | Jamison | |
| 6,649,573 | B2 | 11/2003 | Mitrovich | |
| 6,749,772 | B2 | 6/2004 | Zumdome | |
| 6,854,908 | B2 | 2/2005 | Hui et al. | |
| 6,855,673 | B2 | 2/2005 | Cotter et al. | |
| 6,869,985 | B2 | 3/2005 | Mohanty et al. | |
| 7,045,489 | B2 | 5/2006 | Cotter et al. | |
| 7,244,695 | B2 | 7/2007 | Eadie | |
| 7,683,014 | B2 | 3/2010 | Mitrovich | |
| 7,820,598 | B2 | 10/2010 | Mitrovich | |
| 7,943,556 | B2 | 5/2011 | Mitrovich | |
| 9,015,123 | B1 | 4/2015 | Mathew et al. | |
| 2004/0053790 | A1 | 3/2004 | Cotter et al. | |
| 2005/0136259 | A1 | 6/2005 | Mohanty et al. | |
| 2006/0264336 | A1 | 11/2006 | Hui | |
| 2007/0135315 | A1 | 6/2007 | Mitrovich | |
| 2008/0182766 | A1 | 7/2008 | Cotter et al. | |
| 2008/0220997 | A1 | 9/2008 | Eadie et al. | |

FOREIGN PATENT DOCUMENTS

| | | | |
|---|---|---|---|
| EP | 0372559 | A1 | 6/1990 |
| EP | 0469906 | A1 | 2/1992 |
| EP | 0590959 | A2 | 4/1994 |
| EP | 0774488 | A1 | 11/1996 |
| GB | 2207146 | A | 1/1989 |
| GB | 2223504 | A | 4/1990 |
| WO | 9015123 | A1 | 12/1990 |
| WO | 019243 | A1 | 5/2001 |
| WO | 2006/116877 | A1 | 11/2006 |

OTHER PUBLICATIONS

Erhan, S.Z., Sharma, B.K., Adhvaryu, A. 2005. Industrial lubricants based on high oleic vegetable oils [abstract]. 26th World Congress and Exhibition of the International Society of Fats (ISF). p. 82.

Metabolix, Inc., Provisional Product Data Sheet Mirel P1003/F1005 Injection Molding Grade, dated Mar. 2012.

Plews/Edelmann, Lo-Visc Rail Curve Grease MSDS, Dated Apr. 4, 2011.

* cited by examiner

LUBRICANT COMPOSITIONS

PRIORITY/CROSS-REFERENCE TO RELATED APPLICATIONS

This application is a continuation of U.S. non-provisional application Ser. No. 14/033,159, filed Sep. 20, 2013, which claims the benefit of U.S. Provisional Application No. 61/704,097, filed Sep. 21, 2012.

TECHNICAL FIELD

The disclosure generally relates to the field of lubricants. Particular embodiments relate to biodegradable, solid stick lubricants.

BACKGROUND

For over fifty years heavy haul railroads have used a variety of methods to reduce friction between the rail vehicle wheel flanges, and the gauge face of the rail with which it comes in contact. Railroads and transits have realized they can save substantial amounts of money in lowered maintenance and equipment replacements if lubrication is applied.

There have been many attempts to develop formulations to provide lubrication to rolling/sliding elements such as wheel/rail contact in railroads, particularly where the track curves, a location where the greatest friction between the gauge face and wheel flanges is to be expected. These formulations range from liquid and grease systems, which generally require more expensive application equipment, frequent monitoring and suffer from plugging applicators which limit effectiveness and reliability, to solid stick formulations.

A first method utilizes hundreds of wayside lubricators that eject hydrocarbon petroleum based lubricants onto the gauge face of the rail as the train travels, particularly at curves in the track.

A second method for applying lubricant has been to use track inspection trucks to spray petroleum and/or synthetic grease onto the gauge face of the track as the inspection truck goes around the curve in the track.

A third method is to apply lubricant to the wheel flange of the locomotive, whereupon the lubricant is transferred from the wheel flange of the locomotive to gauge face of the track, and to the wheel flange of the railcars being pulled by the locomotive, the lubricant being passed back through the train as successive wheels come in contact with the rail and pick up some of the lubricant.

These types of lubrication are typically accomplished by spray devices that squirt small amounts of lubricating oil onto wheel flanges. There are inherent problems with the above-described methods of applying lubricant to a gauge face. First, sprayed oil has a tendency to migrate to the tread of the wheel, making it more difficult for the train to stop. Second, lubricants on top of the rail can cause the train wheels to slip, inhibiting the ability of the brakes of the train to slow or stop the train. Further, lubricants (e.g., grease, oil) on top of the rail can make it difficult for the train to gain traction from a stopped position, or when climbing an incline. Finally, to keep oil spray devices in working order, excessive maintenance of the devices is required, costing additional time and expense to the railroad.

An alternative lubrication method which overcomes some of the problems inherent in spraying oil onto the wheel flange of the locomotive has been to use a solid lubricant stick or rod (herein "lubricant stick"). The lubricant stick is inserted into a tube that is then applied by various mechanical means to the flanges of the wheel of a rail vehicle via friction. In such prior lubricant sticks, the lubricant is embedded within a polymeric carrier (typically a petroleum based polymer such as polyethylene). The lubricant stick is pressed against the wheel flange for wearing off, and application of lubricant there-to.

Solid stick formulations, such as those disclosed in U.S. Pat. Nos. 3,537,819, 3,541,011 & 3,729,415 (Davis, et al.) focus on the use of a high molecular weight polyethylene to control lubricant deposition; U.S. Pat. No. 4,915,856 (Jamison) discloses a thermoplastic stick formulation which contains lead and other potentially hazardous metallic powders; U.S. Pat. No. 6,649,573 (Mitrovich) highlights a thermoplastic polymer (various density polyethylene), and a mixture of organic and inorganic extreme pressure additives; and U.S. Pat. No. 7,709,426 (Eadie, et al.), discloses a solid stick composition comprised of a thermosetting resin and a grease. All of these lubricant stick formulations are generally comprised of a non-biodegradable, hydrocarbon-based (polymer) binder, a hydrocarbon grease or oil, and various solid lubricants combined in such a manner that the finished product is in a solid form which is easily handled. These materials are then applied to surfaces requiring lubrication, typically an open journal such as the wheel flange, or tread of a rail wheel. These lubricant sticks are consumed as the rail vehicle moves down the track, and all of the materials contained in the lubricant sticks are dispersed along the rail bed as the rail vehicle progresses.

One prior patent, U.S. Pat. No. 7,943,556 (Mitrovich), discloses environmentally friendly lubricant compositions utilizing a polylactic acid—based polymer such as polyactide (PLA). Environmentally friendly lubricants are desirable because they minimize or eliminate any potential damage to the environment.

SUMMARY OF THE DISCLOSURE

Several exemplary lubricant compositions are described herein. The exemplary lubricant compositions comprising at least one biodegradable plastic, such as polyhydroxyalkanoate and/or polybutylene succinate, and at least one lubricant, such as a vegetable oil.

Additional understanding of the compositions, formulations and methods contemplated and/or claimed by the inventors can be gained by reviewing the detailed description of exemplary compositions, formulations and methods, presented below.

DETAILED DESCRIPTION

The following description provides illustrative examples of that which the inventors regard as their invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless the context clearly dictates otherwise. The use of "including" and grammatically related terms means "including, but not limited to," unless the context clearly dictates otherwise. The use of the articles "a," "an" and "the" are meant to be interpreted as referring to the singular as well as the plural, unless the context clearly dictates otherwise. Thus, for example, reference to "a biodegradable plastic" includes two or more such biodegradable plastics, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment.

The use of "rail vehicle" means a vehicle configured for carrying cargo and/or passengers on any railway, or for maintaining a railway, including but not limited to locomotives, railroad cars, rail cars, railway carriages, rail transit cars, and road-rail vehicles, unless the context clearly dictates otherwise.

The use of "biodegradable" means able to broken down by naturally occurring microorganisms, through decomposition via ultraviolet (UV) radiation (sunlight), by exposure to water, and/or other biological means, unless the context clearly dictates otherwise.

Disclosed herein are exemplary formulations of lubricant compositions. Such exemplary formulations can be utilized to manufacture lubricant sticks, or other forms of lubricants.

The exemplary lubricant compositions disclosed herein include at least one biodegradable plastic, and at least one lubricant, preferably a vegetable oil. By utilizing a biodegradable plastic and a vegetable oil in a lubricant composition, both the polymer component and the oil can be broken down by microorganisms present in the environment. From an environmental perspective, this provides tremendous benefit over all prior art in the fact that hydrocarbon-based thermoplastics and thermoset resins have been used previously which will remain at their point of use for an extended amount of time due to their lack of biodegradability.

BIODEGRADABLE PLASTIC. Biodegradable plastics are plastics that can be biologically broken down, in a reasonable amount of time, into their base compounds, such as $CO_2$ and water. Biodegradable plastics include, but are not limited to: bioplastics, traditional petroleum-based plastics containing additives or chemical structures which allow them to disintegrate, and/or a combination of the two.

Bioplastics are a form of plastics derived from renewable biomass sources (e.g., vegetable fats, vegetable oils, starches, cellulose, biopolymers, microbiota). Some, but not all, bioplastics are designed to biodegrade—the ability of naturally occurring microorganisms to break the materials down over a given period of time. Often the time requirements are dictated by the heat and moisture levels present in the environment. Biodegradable bioplastics are more sustainable because they can break down in the environment faster than fossil-fuel based plastics.

Types of bioplastics include, but are not limited to, starch-based plastics, cellulose-based plastics, some alphatic polyesters, polylactic acid (PLA) plastics, poly-3-hydroxybutyrate (PHB), polyhydroxyalkanoates (PHA), polyamide 11 (PA 11), bio-derived polyethylene, and genetically modified bioplastics.

Current literature indicates four basic commercially available biodegradable plastics on the market today: polybutylene adipate co-terephthalate, polylactic acid, polyhydroxyalkanoate, and polybutylene succinate.

Polybutylene adipate co-terephthalate (PBAT) is a starch-based bioplastic which is commercially produced by BASF under the product name ECOFLEX (e.g., ECOFLEX F). Produced in Germany, PBAT is similar to low-density polyethylene (LDPE), has low moisture reactivity, and is soil biodegradable. PBAT is produced from non-renewable resources, but is biodegradable. BASF also produces (in Germany) a PBAT/PLA blend under the product name ECOVIO. This blend has similar properties to high-density polyethylene (HDPE) (e.g., M5312 HDPE), also produced in Germany. ECOVIO grade was a mixture of approximately 55% PBAT/45% PLA. The PLA contained 4% "D" content.

Polylactic acid (PLA) is a transparent bioplastic produced from corn sugar, cane sugar or glucose (renewable resources). One PLA manufacturer is Nature Works LLC in Blair, Nebr. PLA is very hard and rigid. PLA is not necessarily biodegradable in soil. Composting is recommended for biodegradation. PLA has a higher glass transition temperature, and thus can be considered brittle compared to other plastics. Different grades of PLA are available, some with crystal structures and some that are amorphous, which is largely controlled by "D" content or left vs. right handed molecules of lactic acid.

Polyhydroxyalkanoate (PHA)—PHAs are bioplastics, linear polyesters produced in nature by bacterial fermentation of sugar or lipids. PHAs are polyesters, but they can also imitate polypropylene, polystyrene, and polyethylene. PHAs are considered to be the broadest biopolymer because they are their own class, and can have many different chemical structures. These polymers have a wide range of properties ranging from stiff and brittle plastics, to rubberlike materials. They also can exhibit properties similar to many synthetic polymers. There are currently 100 different monomer types of PHA that have been discovered. PHA is biodegradable in soil, and is able to fully degrade into carbon dioxide and water, leaving no environmentally harming waste behind. PHA has low elongations, and is much stiffer, having a stiffness generally between what is found in PBAT and PLA. One manufacturer of PHA is Metabolix, Inc. (under the brand name MIREL).

Polybutylene succinate (PBS) is a biodegradable plastic. PBS is an aliphatic polyester resin which was previously only produced from non-renewable (hydrocarbon oil) resources. Manufacturer Showa Denko K.K. has indicated it has developed a process for preparing bioplastic PBS from bio-derived raw materials (succinic acid made from starches or sugars). Showa Denko K.K.'s PBS product is sold under the brand name BIONOLLE.

These biodegradable plastics are not intended to be a list of the only biodegradable plastics that could be utilized in exemplary lubricant compositions. A skilled artisan will be able to select an appropriate biodegradable plastic in a particular embodiment based on various considerations, including the intended use of the lubricant composition, the intended arena within which the lubricant composition will be used, and the equipment and/or accessories with which the lubricant composition is intended to be used, among other considerations.

Preferably, the biodegradable plastic(s) begins in one of two forms: powder form or pellet form. When in a pellet form, the pellets are usually between 0.10 inch and 0.15 inch, and are irregularly shaped, or in ball, cylinder or hexagon shapes.

LUBRICANT. Exemplary lubricant compositions comprise at least one lubricating oil component, and/or at least one solid lubricant component. The lubricant for assisting in further reducing the coefficient of friction between the two steel surfaces.

LUBRICATING OIL COMPONENT. Exemplary lubricant compositions may comprise at least one lubricating oil component. The incorporation of a lubricating oil component, preferably at least one biodegradable oil, more preferably a vegetable oil containing a high oleic content, and a mixture of solid lubricants, into the biodegradable plastic mixture assists in further reducing the coefficient of friction between the two steel surfaces.

The term "lubricating oil" refers to a lubricant comprising at least one vegetable oil, hydrocarbon oil, mineral oil, synthetic oil, or mixture thereof. A vegetable oil is a triglyceride extracted from a plant. As used herein, the term "vegetable oil" is broadly defined without regard to a substance's state of matter at a given temperature. Vegetable oils are soluble in most organic solvents and insoluble in polar substrates such as water. Vegetable oils can have a broad range of fatty acid profiles. The proportion of each of these fatty acids depends on the vegetable type, the growing season and the geography-factors that can dramatically affect the performance of the vegetable oil in terms of oxidative stability, cold flow, hydrolytic stability and other performance characteristics. Vegetable oils having high oleic content (high in monounsaturated fats), and low polyunsaturated fatty acid content, typically display good oxidative stability with acceptable low temperature properties. Because of that fact, "high oleic" vegetable oils are well suited for use in lubricant compositions as compared to more conventional vegetable oils. Vegetable oils are biodegradable.

Table A, entitled "Friction and Load Bearing Properties of Vegetable Oils," provides an overview of the performance characteristics (as lubricants) of various vegetable oils. Table A is based on data from TRIBOLOGY DATA HANDBOOK: AN EXCELLENT FRICTION, LUBRICATION, AND WEAR RESOURCE by E. Richard Booser.

TABLE A

| | Test A | Test B | Test C | Test D |
|---|---|---|---|---|
| Canola | 0.87/0.07 | 63/126/24.5 | 54 (90) | 22 (13300) |
| Castor | 0.51/0.04 | 63/126/22.2 | 29 (58) | 30 (14500) |
| Corn | 0.84/0.07 | 63/126/25.4 | 25 (90) | |
| Lesquerella | 0.63/0.05 | 63/126/25.4 | 41 (90) | 30 (18127) |
| Meadowfoam | 0.6/0.073 | | | |
| Olive | 0.61/0.08 | 63/126/21.6 | 16 (70) | |
| Peanut | 0.63/0.07 | 63/126/21.5 | 20 (114) | |
| Rice Bran | 0.75/0.11 | 63/126/21.2 | 21 (49) | |
| Safflower | 0.66/0.08 | 63/126/24.2 | 39 (87) | |
| Sesame | 0.66/0.063 | | 33 (88) | |
| Soybean | 0.66/0.08 | | 24 (98) | |
| Sunflower | 0.69/0.08 | 63/126/21.9 | 58 (103) | 15 (11538) |
| Walnut | 0.57/0.09 | 50/126/17.8 | | |

In Table A, Test A is a four (4) ball wear test using standard test method ASTM D2672, measured in Scar Dia./COF. Test B is a Shell 4-Ball EP test using standard test method ASTM D2783, measured in Seizure/Weld/LWI. Test C is a Falex Wear test using standard test method ASTM D2670, measured in No. of Teeth (Temp. Diff.). Test D is a Timken "OK" Load test using standard test method ASTM D2509/2782, measured in "OK" Load (lbs).

Table A discloses the friction and load bearing properties of a number of vegetable oils, namely canola oil, castor oil, corn oil, Lesquerella oil, meadowfoam oil, olive oil, peanut oil, rice bran oil, safflower oil, sesame oil, soybean oil, sunflower oil, and walnut oil.

Referring to Table A, oils with high oleic content (e.g., Sunflower, Canola, Palm, Soy) provide improved lubrication in comparison to those having lower oleic content. Other vegetable oils (e.g., castor oil, meadowfoam oil) also contain significant amounts of fatty acid groups with chemical functionality, in addition to saturated and unsaturated fatty acids. Because of the presence of chemical functionality, these oils can be subjected to chemical modification that can be exploited in lubricating applications. Castor oil also has comparatively better oxidative stability, lower temperature viscosity properties, higher friction reduction performance, high vapor point for processing stability, and higher load bearing properties than most other vegetable oil lubricants.

Table A is not intended to be an all inclusive list of all possible vegetable oils which could be utilized in exemplary lubricant composition which comprises at least one vegetable oil. Further, Table A is not intended to be an all inclusive list of all possible oils which could be utilized in exemplary lubricant composition. Other, types of oils can be used for the lubricating oil component, including but not limited to synthetic biodegradable oils, and mineral oils. A skilled artisan will be able to select an appropriate lubricating oil component in a particular embodiment based on various considerations, including the intended use of the lubricant composition, the intended arena within which the lubricant composition will be used, and the equipment and/or accessories with which the lubricant composition is intended to be used, among other considerations. For instance, a skilled artisan could consider the friction and load bearing characteristics, in combination with a high vapor point in order to withstand bio-polymer processing temperatures, in selecting the appropriate lubricating oil component for the application.

SOLID LUBRICANT COMPONENT. Exemplary lubricant compositions may comprise at least one solid lubricant component. The solid lubricant component for use as an anti-wear additive and/or as a lubricant carrier for the lubricating oil component. Solid lubricants can be particularly useful when the lubricating oil component is a vegetable oil due to the fact that vegetable oil is typically insoluble with biodegradable plastics (unlike mineral oil is with polyethylene). By mixing the vegetable oil(s) into the solid lubricant(s) before incorporation into the biodegradable plastic, the solid lubricant(s) bind the vegetable oil(s) up within the lubricant composition, keeping the vegetable oil(s) from separating from the lubricant composition.

The solid lubricant component preferably comprising at least one solid lubricant, preferably in powder form. The solid lubricant component may comprise a mixture of organic and/or inorganic solid extreme pressure lubricants. Suitable solid lubricants include, but are not limited to, molybdenum disulfide powder, graphite powder, talc powder, mica powder, calcium carbonate powder, and Bentonite clay (an absorbent aluminum phyllosilicate, essentially impure clay consisting mostly of montmorillonite).

This is not intended to be an all inclusive list of all possible solid lubricant components. A skilled artisan will be able to select an appropriate solid lubricant component in a particular embodiment based on various considerations, including the intended use of the lubricant composition, the intended arena within which the lubricant composition will be used, and the equipment and/or accessories with which the lubricant composition is intended to be used, among other considerations.

ADDITIVES. Exemplary lubricant compositions may comprise one or more additives, whereas other exemplary lubricant compositions will not comprise any additives. Additives may be utilized to provide additional benefits to the lubricant composition, for instance, increasing the stability of the lubricant composition, and increasing the effectiveness of the lubricant composition. Additives include, but are not limited to, anti-wear additives (e.g., sulfur containing compounds, phosphorous containing compounds), corrosion inhibitors, antioxidants, additional forms of free fatty acids to create a reacted layer for boundary lubrication, optical brighteners, non-biodegradable polymers (e.g., HDPE, LDPE), and tackifiers.

This is not intended to be an all inclusive list of all possible additives. A skilled artisan will be able to select an appropriate additive in a particular embodiment based on various considerations, including the intended use of the lubricant, the intended arena within which the lubricant will be used, and the equipment and/or accessories with which the lubricant is intended to be used, among other considerations.

Tackifiers are used to improve transfer rates of the lubricant and ensure the applied lubricant composition remains in place to provide needed lubrication. The purpose of using an optical brightener is so that by using a black light, the lubricant composition deposition on wheel flanges or rail track can be verified.

TESTING. While the effectiveness of polyethylene (HDPE, LDPE) based lubricant compositions (where the polyethylene is used as a polymer binder for delivery for solid lubricants) is known, none of the commercially available biodegradable plastics possess the same physical characteristics as polyethylene, as is provided in Table B ("Summary of Properties").

As shown in Table B, extensive testing was conducted on a number of exemplary lubricant composition formulations containing a variety of biodegradable plastic materials combined with varying levels of lubricating oil components, and then subjecting the lubricant composition to performance testing at a range of journal speeds to determine each biodegradable plastic material's ability to consistently provide a uniform layer of lubrication while not excessively abrading or melting.

properties required to withstand steel surface application at varying speeds. While the physical properties of the chemistries for PBAT and PLA do not allow them to perform in an ideal manner which would allow them to serve as an effective binder material in a flange lubrication application, exemplary lubricant compositions can comprise PBAT and/or PLA. At high contact speeds, both materials tend to abrade at a very high rate of speed and do not provide proper "dosing" of the lubricants to the wheel.

Third, evaluation of polyhydroxyalkanoate (PHA) (e.g., Mirel 1003) indicates slightly deficient mechanical properties with respect to wear resistance; however, PHA does exhibit acceptable thermal properties. Testing indicates that while a lubricant stick having a polymer content solely comprising PHA is effective at transferring lubricants (oil and solid lubricants), the wear rate is excessive at higher journal speeds, and will not provide lubrication over the desired mileage requirements. As such, a polymer content solely comprising PHA is less preferred, but could be utilized.

Fourth, while polybutylene succinate (PBS) (e.g., 1001 MD) exhibited wear resistance mechanical properties which prevented effective material transfer (low dosing rate when compared to PHA) to the steel surfaces, PBS did possess acceptable thermal properties. PBS was found to be effective across all speed ranges tested. As a result, a lubricant stick having a polymer content solely comprising PBS would be too abrasion resistant, and would not apply a sufficient amount of lubricant to the surfaces during normal operating conditions. As such, a polymer content solely comprising PBS is less preferred, but could be utilized.

A blend of PHA and PBS has proven effective at controlling dosing rates across the effective range of speeds encountered on a rail vehicle. In an effort to achieve a desired transfer rate of lubricant composition, it was determined that by utilizing both PHA and PBS together, the application rate could be adjusted based on ratio of the two biodegradable plastics. By formulating lubricant compositions to comprise both PHA and PBS in a given ratio, the lubrication rate is able to be adjusted to a desired application rate.

Thus, while all of the biodegradable plastics discussed herein work to a certain extent, the mixture of PBS and PHA appears to offer the most desirable characteristics for rail

TABLE B

| | HDPE | LDPE | PBAT | PBAT/PLA | PLA | PHA | PBS |
|---|---|---|---|---|---|---|---|
| Density g/cm^3 | .953 | .920 | 1.26 | 1.25 | 1.24 | 1.40 | 1.26 |
| MFR (190° C. 2.16 kg) | 2 | 2 | 4 | 2.5 | — | — | 1.3 |
| Melting ° F. | 270° | 226° | 235° | 275° | 293° | 325° | 237° |
| Hardness Shore D | 67 | | 32 | 59 | 80 | | 61 |
| Tensile Yield MPa | 27 | 12 | 35 | 27 | 45 | 25 | 32 |
| Tensile Break MPa | 39 | 35 | 36 | 36 | 53 | 26 | 57 |
| Youngs Modulus MPa | 1250 | — | 80 | 550 | 3600 | 3400 | 470 |
| Flexural Modulus MPa | 1070 | 180 | — | — | — | 3170 | 660 |
| Elongation % | 600 | 400 | 560 | 300 | 6 | 3 | 700 |
| Vicat Softening ° F. | 259° | — | 176° | 154° | 120° | 255° | — |
| Glass Transition ° F. | −105° | −184° | — | — | 131° | ~40° | −25° |
| HDT .45 MPa ° F. | 162° | 190° | — | — | 131° | 269° | 207° |
| Specific Heat (BTU/lbs ° F. at 70 F.) | 0.54 | — | — | — | 0.28 | 0.65 | — |

A number of conclusions can be drawn from these test results. First, polybutylene adipate co-terephthalate (PBAT) (e.g., ECOFLEX F) alone lacks the desired thermal and mechanical properties. Second, while polylactic acid (PLA) (e.g., NatureWorks PLA Polymer 4060D) possesses effective mechanical properties, PLA lacks the desired thermal vehicle wheel flange lubrication. The biodegradable plastics tested and evaluated during the course of testing were all commercially available in large quantities; other variations of biodegradable plastics currently in lab scale development may have application, however were not considered for testing due to limited availability.

MANUFACTURING METHOD. Exemplary lubricant compositions can be compounded, and then produced, using any traditional plastics manufacturing technology (e.g., injection molding, thermoforming, extrusion (twin or single)) into lubricant sticks configured for applying to surfaces which are in sliding or rolling-sliding contact.

A first exemplary manufacturing method comprises processing the constituents of the lubricant composition on a twin screw extruder which heats and mixes the components together. A second exemplary manufacturing method comprises utilizing a single screw extruder. A third exemplary manufacturing method comprises using manufacturing methods, such as those disclosed in U.S. Pat. No. 6,649,573 (Mitrovich), to form multi-part lubricant sticks from one or more exemplary lubricant compositions. For example, the first portion of a lubricant stick could include a lubricant composition comprising a first biodegradable plastic, whereas the second portion of the lubricant stick could include a lubricant composition comprising a second biodegradable plastic. In another example, both portions of the lubricant composition could include the biodegradable plastic, and/or various portions of a lubricant stick could have lubricant compositions comprising various ratios of biodegradable plastics used therein.

This disclosure is not intended to be an all inclusive list of all possible processing and/or manufacturing methods for manufacturing exemplary lubricant sticks from an exemplary lubricant composition. A skilled artisan will be able to select an appropriate processing and/or manufacturing method in a particular embodiment based on various considerations, including the intended use of the lubricant composition, the intended arena within which the lubricant composition will be used, and the equipment and/or accessories with which the lubricant composition is intended to be used, among other considerations.

One example of processing parameters for an exemplary lubricant composition are as follows: temperature range for heating zones: 300°-360° F. (148°-182° C.); screw RPM: 60-100 rpm (optimal); and a 40:1 length to diameter screw profile. This example is not intended to be an all inclusive list of all possible processing parameters. A skilled artisan will be able to select an appropriate processing parameter in a particular embodiment based on various considerations, including the intended use of the lubricant composition, the intended arena within which the lubricant composition will be used, and the equipment and/or accessories with which the lubricant composition is intended to be used, among other considerations.

In an first exemplary process of manufacturing a lubricant stick from an exemplary lubricant composition, the process comprises blending the components of the formulation together, extruding or otherwise forming the formulation into a stock material (e.g., pellets), forming a solid lubricant stick (e.g., via extrusion, transfer molding, injection molding).

In a second exemplary process of manufacturing a lubricant stick from an exemplary lubricant composition, the process comprises the steps of: (a) blending one or more solid lubricant components into one or more lubricating oil components to form a lubricant portion; (b) blending the lubricant portion, the biodegradable plastic(s), and additives (if any) together to form a stock material; and (c) forming a lubricant stick from said stock material (e.g., via extrusion, transfer molding, injection molding).

In a third exemplary process of manufacturing a lubricant stick from an exemplary lubricant composition, the process comprises blending (e.g., mixing very well with a heavy duty mixer that confines dust, other manners of pelletizing the ingredients that keeps dust from flying freely) the components of the formulation (e.g., biodegradable plastics, vegetable oils, lubricant powders, additives) to form a stock material, and forming a solid lubricant stick (e.g., via extrusion, transfer molding, injection molding) from said stock material.

These exemplary processes of manufacturing a lubricant stick from an exemplary lubricant composition are not intended to be an all inclusive list of all possible manufacturing processes. A skilled artisan will be able to select an appropriate manufacturing processes in a particular embodiment based on various considerations, including the intended use of the lubricant composition, the intended arena within which the lubricant composition will be used, and the equipment and/or accessories with which the lubricant composition is intended to be used, among other considerations.

EXEMPLARY METHODS OF REDUCING WHEEL AND RAIL CONTACT FRICTION FOR RAILROADS BY CONTROLLED DOSING OF LUBRICANT ONTO A WHEEL FLANGE OF A RAIL VEHICLE ON A TRACK. Disclosed herein are a plurality of exemplary methods of reducing wheel and rail contact friction for railroads by controlled dosing of lubricant onto a wheel flange of a rail vehicle on a track.

In a first exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, and wherein the biodegradable plastic component abraded from the consumable dosing stick is dispersed along said track.

In a second exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable plastic component comprises from 45% to 90% by weight of said biodegradable dosing composition.

In a third exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable plastic component comprises from 38% to about 75% by weight of said biodegradable dosing composition.

In a fourth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein the biodegradable plastic component comprises between about 50% and about 75% by weight polyhydroxyalkanoate, and between about 25% and about 50% by weight polybutylene succinate.

In a fifth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein the biodegradable lubricating oil component comprises a vegetable oil. In some aspects, the vegetable oil comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil. In a sixth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition further comprises about 5% to about 28% by weight of said biodegradable lubricating oil component.

In a seventh exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition comprises at least a 2:1 ratio of said solid lubricant component to said biodegradable lubricating oil component.

In a eighth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein the biodegradable dosing composition comprises about 5% to about 50% by weight of said solid lubricant component.

In a ninth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition further comprises at least one additive.

In a tenth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein the biodegradable plastic component comprises 45% to 90% by weight of said biodegradable dosing composition, and wherein the biodegradable plastic component comprises between about 50% and about 75% by weight polyhydroxyalkanoate, and between about 25% and about 50% by weight polybutylene succinate. In some aspects, the biodegradable lubricating oil component comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil.

In an eleventh exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, wherein the biodegradable plastic component comprises 38% to about 75% by weight of the biodegradable dosing composition, and wherein the biodegradable plastic component comprises between about 50% and about 75% by weight polyhydroxyalkanoate, and between about 25% and about 50% by weight polybutylene succinate. In some aspects, the biodegradable lubricating oil component comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil.

In a twelfth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition further comprises about 5% to about 28% by weight of said biodegradable lubricating oil component, and wherein said biodegradable dosing composition comprises at least a 2:1 ratio of said solid lubricant component to said biodegradable lubricating oil component.

In a thirteenth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition comprises about 5% to about 28% by weight of said biodegradable lubricating oil component, and about 5% to about 50% by weight of said solid lubricant component.

In a fourteenth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition comprises at least a 2:1 ratio of said solid lubricant component to said biodegradable lubricating oil component, and wherein the biodegradable dosing composition comprises about 5% to about 50% by weight of said solid lubricant component.

In a fifteenth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein said biodegradable dosing composition further comprises about 5% to about 28% by weight of said biodegradable lubricating oil component, at least a 2:1 ratio of said solid lubricant component to said biodegradable lubricating oil component, and about 5% to about 50% by weight of said solid lubricant component. In some aspects, the biodegradable plastic component comprises between about 50% and about 75% by weight polyhydroxyalkanoate, and between about 25% and about 50% by weight polybutylene succinate.

In a sixteenth exemplary method of reducing wheel and rail contact friction for railroads by controlled dosing of lubricant onto a wheel flange of a rail vehicle on a track, the method comprises providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition; forming said biodegradable dosing composition into a consumable dosing stick having a first end; utilizing an applicator to press the first end of the consumable dosing stick against the wheel flange of the rail vehicle; and abrading the consumable dosing stick against the wheel flange, wherein solid lubricant component and biodegradable lubricating oil abraded from the consumable dosing stick is applied to the wheel flange of the rail vehicle, wherein the biodegradable plastic component abraded from the consumable dosing stick is dispersed along said track, and wherein the step of forming said biodegradable dosing composition into a consumable dosing stick having a first end comprises blending the biodegradable plastic component, the solid lubricant component and the biodegradable lubricating oil component together, extruding the blended components into a stock material, and forming said consumable dosing stick by extrusion of the stock material.

EXEMPLARY LUBRICANT COMPOSITION FORMULATIONS. Disclosed herein are a plurality of exemplary lubricant composition formulations.

Exemplary lubricant composition formulations comprises at least one biodegradable plastic in combination with at least one lubricant.

The biodegradable plastic portion in an exemplary lubricant composition can comprise from about 30% to about 90% by weight of the formulation, and more preferably from about 38% to about 75%.

The lubricating oil component in an exemplary lubricant composition can comprise from about 5% to about 50% by weight of the formulation, and more preferably from about 5% to about 28%.

The solid lubricant component in an exemplary lubricant composition can comprise from about 5% to about 75% by weight of the formulation, and more preferably from about 5% to about 50%.

The additive component, if an exemplary lubricant composition includes an additive, can comprise from about 0% to about 10% by weight of the formulation. If an exemplary lubricant composition includes an optical brightener, about 1% by weight of optical brightener is preferred in the formulation to ensure visibility, however 0% to about 1% by weight may be utilized.

A first exemplary lubricant composition comprises at least one biodegradable plastic, and at least one lubricant.

A second exemplary lubricant composition comprises at least one biodegradable plastic, and at least one lubricant, wherein the lubricant comprises at least one lubricating oil component.

A third exemplary lubricant composition comprises at least one biodegradable plastic, and at least one lubricant, wherein the lubricant comprises at least one solid lubricant component.

A fourth exemplary lubricant composition comprises at least one biodegradable plastic, and at least one lubricant, wherein the lubricant comprises at least one solid lubricant component selected from the group consisting of molybdenum disulfide, graphite, talc, mica, calcium carbonate, and Bentonite clay.

A fifth exemplary lubricant composition comprises at least one biodegradable plastic, and at least one lubricant, wherein the lubricant comprises at least one solid lubricant component, wherein said solid lubricant component is molybdenum disulfide.

A sixth exemplary lubricant composition comprises at least one biodegradable plastic, and at least one lubricant, wherein the lubricant comprises at least one solid lubricant component, wherein said solid lubricant component is graphite.

A seventh exemplary lubricant composition comprises at least one biodegradable plastic, and at least one lubricant, wherein the lubricant comprises about 5% to about 50% of at least one solid lubricant component.

An eighth exemplary lubricant composition comprises at least one biodegradable plastic, and at least one lubricant, wherein the lubricant comprises at least one lubricating oil component and at least one solid lubricant component.

A ninth exemplary lubricant composition comprises at least one biodegradable plastic, at least one lubricant, and at least one additive.

A tenth exemplary lubricant composition comprises at least one biodegradable plastic, at least one lubricant, and about 0% to about 10% of at least one additive.

An eleventh exemplary lubricant composition comprises polyhydroxyalkanoate (PHA), polybutylene succinate (PBS), at least one vegetable oil, and at least one solid lubricant component.

A twelfth exemplary lubricant composition comprises polyhydroxyalkanoate (PHA), polybutylene succinate (PBS), and at least one lubricant.

A thirteenth exemplary lubricant composition comprises polyhydroxyalkanoate (PHA), at least one vegetable oil, and at least one solid lubricant component.

A fourteenth exemplary lubricant composition comprises polyhydroxyalkanoate (PHA) in combination with at least one lubricant.

A fifteenth exemplary lubricant composition comprises polybutylene succinate (PBS), at least one vegetable oil, and at least one solid lubricant component.

A sixteenth exemplary lubricant composition comprises polybutylene succinate (PBS) and at least one lubricant.

A seventeenth exemplary lubricant composition comprises about 39% polyhydroxyalkanoate (PHA), about 17% by weight of at least one vegetable oil, and about 44% by weight of at least one solid lubricant component.

An eighteenth exemplary lubricant composition comprises about 45% by weight polyhydroxyalkanoate (PHA), about 25% by weight of at least one vegetable oil, and about 30% by weight of at least one solid lubricant component.

A nineteenth exemplary lubricant composition comprises 46% by weight polyhydroxyalkanoate (PHA), 26% by weight of at least one vegetable oil, and 28% by weight of at least one solid lubricant component.

A twentieth exemplary lubricant composition comprises about 45% by weight polybutylene succinate (PBS), about 25% by weight of at least one vegetable oil, and about 30% by weight of at least one solid lubricant component.

A twenty-first exemplary lubricant composition comprises about 38% by weight polybutylene succinate (PBS), about 28% by weight of at least one vegetable oil, and about 35% by weight solid lubricant component.

A twenty-second exemplary lubricant composition comprises about 38% by weight polybutylene succinate (PBS), about 25% by weight of at least one vegetable oil, and about 38% by weight of at least one solid lubricant component.

A twenty-third exemplary lubricant composition comprises about 42% by weight polybutylene succinate (PBS), about 26% by weight of at least one vegetable oil, and about 32% by weight of at least one solid lubricant component.

A twenty-fourth exemplary lubricant composition comprises about 45% by weight biodegradable plastic, about 25% by weight of at least one vegetable oil, and about 30% by weight of at least one solid lubricant component, wherein the biodegradable plastic comprises about 75% by weight polyhydroxyalkanoate (PHA) and about 25% polybutylene succinate (PBS).

A twenty-fifth exemplary lubricant composition comprises about 44% biodegradable plastic by weight, about 25% by weight of at least one vegetable oil, about 30% by weight of at least one solid lubricant component, and about 1% by weight of an additive, wherein the biodegradable plastic comprises about 65% polyhydroxyalkanoate (PHA) by weight and about 35% polybutylene succinate (PBS) by weight.

A twenty-sixth exemplary lubricant composition comprises about 44% by weight biodegradable plastic, about 26% by weight of at least one vegetable oil, and about 31% by weight of at least one solid lubricant component, wherein the biodegradable plastic comprises about 65% by weight polyhydroxyalkanoate (PHA) and about by weight 35% polybutylene succinate (PBS).

A twenty-seventh exemplary lubricant composition comprises about 38% by weight to about 46% by weight of at least one biodegradable plastic, about 17% by weight to about 28% by weight of at least one lubricating oil component, about 28% by weight to about 44% by weight of at least one solid lubricant component, and 0% by weight to about 10% by weight of at least one additive.

A twenty-eighth exemplary lubricant composition comprises about 38% by weight to about 46% by weight of at least one biodegradable plastic, about 17% by weight to about 28% by weight of at least one lubricating oil component, about 28% by weight to about 44% by weight of at least one solid lubricant component, and 0% by weight to about 10% by weight of at least one additive, wherein the biodegradable plastic comprises about 60% by weight to about 90% by weight polyhydroxyalkanoate (PHA), about 10% by weight to about 40% by weight polybutylene succinate (PBS).

A twenty-ninth exemplary lubricant composition comprises about 38% by weight to about 46% by weight of at least one biodegradable plastic, about 17% by weight to about 28% by weight of at least one lubricating oil component, about 28% by weight to about 44% by weight of at least one solid lubricant component, and 0% by weight to about 10% by weight of at least one additive, wherein the biodegradable plastic comprises about 75% by weight polyhydroxyalkanoate (PHA) and about 25% by weight polybutylene succinate (PBS).

Any suitable ratio of the disclosed components can be used in exemplary lubricant compositions, and a skilled artisan will be able to select an appropriate ratio of components for the lubricant composition in a particular embodiment based on various considerations, including the intended use of the lubricant composition, the intended arena within which the lubricant composition will be used, and the equipment and/or accessories with which the lubricant composition is intended to be used, among other considerations. Materials hereinafter discovered and/or developed that are determined to be suitable for use in lubricant composition formulations would also be considered suitable for use in a lubricant composition according to a particular embodiment.

It is noted that all structure and features of the various described and illustrated embodiments can be combined in any suitable configuration for inclusion in a lubricant composition according to a particular embodiment. For example, a lubricant composition according a particular embodiment can the percent biodegradable plastic from one exemplary lubricant composition, and the percent lubricant from a different exemplary lubricant composition.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A method of reducing wheel and rail contact friction for railroads by controlled dosing of lubricant onto a wheel flange of a rail vehicle on a track, said method comprising:

providing a biodegradable dosing composition comprising a biodegradable plastic component, a solid lubricant component, and a biodegradable lubricating oil component, wherein said biodegradable plastic component comprises a mixture of polyhydroxyalkanoate and polybutylene succinate, wherein the solid lubricant component comprises at least one of graphite, molybdenum disulfide, and a mixture of graphite and molybdenum disulfide, wherein said biodegradable plastic component comprises from about 30% to about 90% by weight of said biodegradable dosing composition, wherein said biodegradable lubricating oil component comprises from about 5% to about 50% by weight of said biodegradable dosing composition, and wherein said solid lubricant component comprises from about 5% to about 75% by weight said biodegradable dosing composition;

forming said biodegradable dosing composition into a dosing stick having a first end;

utilizing an applicator to press the first end of the dosing stick against the wheel flange of the rail vehicle; and abrading the dosing stick against the wheel flange, wherein solid lubricant component and biodegradable lubricating oil abraded from the dosing stick is applied to the wheel flange of the rail vehicle, and wherein the biodegradable plastic component abraded from the dosing stick is dispersed along said track.

2. The method of claim 1, wherein said biodegradable plastic component comprises from 45% to 90% by weight of said biodegradable dosing composition.

3. The method of claim 1, wherein said biodegradable plastic component comprises from 38% to about 75% by weight of said biodegradable dosing composition.

4. The method of claim 1, wherein the biodegradable plastic component comprises between about 50% and about 75% by weight polyhydroxyalkanoate, and between about 25% and about 50% by weight polybutylene succinate.

5. The method of claim 1, wherein the biodegradable lubricating oil component comprises a vegetable oil.

6. The method of claim 5, wherein the vegetable oil comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil.

7. The method of claim 1, wherein said biodegradable dosing composition further comprises about 5% to about 28% by weight of said biodegradable lubricating oil component.

8. The method of claim 1, wherein said biodegradable dosing composition comprises at least a 2:1 ratio of said solid lubricant component to said biodegradable lubricating oil component.

9. The method of claim 1, wherein the biodegradable dosing composition comprises about 5% to about 50% by weight of said solid lubricant component.

10. The method of claim 1, wherein said biodegradable dosing composition further comprises at least one additive.

11. The method of claim 1, wherein the biodegradable plastic component comprises 45% to 90% by weight of said biodegradable dosing composition, and wherein the biodegradable plastic component comprises between about 50% and about 75% by weight polyhydroxyalkanoate, and between about 25% and about 50% by weight polybutylene succinate.

12. The method of claim 11, wherein the biodegradable lubricating oil component comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil.

13. The method of claim 1, wherein the biodegradable plastic component comprises 38% to about 75% by weight of the biodegradable dosing composition, and wherein the biodegradable plastic component comprises between about 50% and about 75% by weight polyhydroxyalkanoate, and between about 25% and about 50% by weight polybutylene succinate.

14. The method of claim 13, wherein the biodegradable lubricating oil component comprises at least one vegetable oil selected from the group consisting of canola oil, castor oil, corn oil, Lesquerella oil, meadowfoam oil, olive oil, peanut oil, rice bran oil, safflower oil, sesame oil, soybean oil, sunflower oil, and walnut oil.

15. The method of claim 1, wherein said biodegradable dosing composition further comprises about 5% to about 28% by weight of said biodegradable lubricating oil component, and wherein said biodegradable dosing composition comprises at least a 2:1 ratio of said solid lubricant component to said biodegradable lubricating oil component.

16. The method of claim 1, wherein said biodegradable dosing composition comprises about 5% to about 28% by weight of said biodegradable lubricating oil component, and about 5% to about 50% by weight of said solid lubricant component.

17. The method of claim 1, wherein said biodegradable dosing composition comprises at least a 2:1 ratio of said solid lubricant component to said biodegradable lubricating oil component, and wherein the biodegradable dosing composition comprises about 5% to about 50% by weight of said solid lubricant component.

18. The method of claim 1, wherein said biodegradable dosing composition further comprises at least a 2:1 ratio of said solid lubricant component to said biodegradable lubricating oil component, and about 5% to about 50% by weight of said solid lubricant component.

19. The method of claim 18, wherein the biodegradable plastic component comprises between about 50% and about 75% by weight polyhydroxyalkanoate, and between about 25% and about 50% by weight polybutylene succinate.

20. The method of claim 1, wherein the step of forming said biodegradable dosing composition into a dosing stick having a first end comprises blending the biodegradable plastic component, the solid lubricant component and the biodegradable lubricating oil component together, extruding the blended components into a stock material, and forming said dosing stick by extrusion of the stock material.

* * * * *